US005107786A

United States Patent [19]

Templeman

[11] Patent Number: 5,107,786

[45] **Date of Patent: * Apr. 28, 1992**

[54] ADJUSTABLE BOAT STABILIZER

[75] Inventor: Arthur R. Templeman, Overland Park, Kans.

[73] Assignee: Marine Dynamics, Inc., Overland Park, Kans.

[ * ] Notice: The portion of the term of this patent subsequent to Sep. 17, 2008 has been disclaimed.

[21] Appl. No.: 599,891

[22] Filed: Oct. 18, 1990

Related U.S. Application Data

[63] Continuation of Ser. No. 478,589, Feb. 9, 1990, which is a continuation-in-part of Ser. No. 210,697, Jun. 23, 1988, Pat. No. Des. 308,851.

[51] Int. Cl.[5] ..... B63B 1/24

[52] U.S. Cl. ..... 114/280; 114/274

[58] Field of Search ..... 114/284-288, 114/271, 274, 145 A, 281; 440/49, 66, 68, 69, 900; D12/317, 309; D21/230

[56] References Cited

U.S. PATENT DOCUMENTS

| | | | |
|---|---|---|---|
| 2,021,309 | 11/1935 | Irgens | 115/17 |
| 2,319,640 | 5/1943 | Sink | 115/42 |
| 2,963,000 | 12/1960 | Fester | 115/42 |
| 2,998,795 | 9/1961 | Downie et al. | 114/145 |
| 3,099,240 | 7/1963 | Montague, Jr. | 114/66.5 |
| 3,114,343 | 12/1963 | Headrick et al. | 114/66.5 |
| 3,139,853 | 7/1964 | McCarthy et al. | 115/17 |
| 3,211,119 | 10/1965 | Kiekhaefer | 114/66.5 |
| 3,343,512 | 9/1967 | Rasmussen | 114/66.5 |
| 3,433,195 | 3/1969 | Poole | 114/66.5 |
| 3,765,356 | 10/1973 | Cook | 114/66.5 |
| 3,964,417 | 6/1976 | Williams et al. | 114/66.5 |
| 4,040,373 | 8/1977 | Jones, Jr. | 114/126 |
| 4,205,618 | 6/1980 | Olsson | 114/281 |
| 4,323,355 | 4/1982 | Kondo | 440/900 |
| 4,487,152 | 12/1984 | Larson | 114/274 |
| 4,597,742 | 7/1986 | Finkl | 440/61 |
| 4,708,672 | 11/1987 | Bentz et al. | 440/51 |
| 4,738,644 | 4/1988 | Happel | 440/900 |
| 4,744,779 | 5/1988 | Koehler | 440/900 |
| 4,756,265 | 7/1988 | Lane | 114/280 |
| 4,977,847 | 12/1990 | Bartlett | 114/274 |

FOREIGN PATENT DOCUMENTS 716879 10/1954 United Kingdom .

OTHER PUBLICATIONS

A brochure entitled "Stingray TM Hydrofoil Stabilizer", published by Marine Dynamics, Inc. beginning in 1988.

A brochure entitled "Doel-Fin TM Boat Stabilizer", published by Doelcher Products, Inc. (date unknown).

An article entitled "Doel Fin—Not Just Another Gadget", dated Jul. 1979.

An article/advertisement entitled "Boat Handling/Gas Saving Break-Through" (regarding the Doel-Fin Boat Stabilizer) (date unknown).

An advertisement entitled "Hydrofoil G.T. TM", published by Hydrofoil International Corp. in Jun. of 1989.

*Primary Examiner*—Joseph F. Peters, Jr.
*Assistant Examiner*—Clifford T. Bartz
*Attorney, Agent, or Firm*—Laney, Dougherty, Hessin & Beavers

[57] ABSTRACT

A boat stabilizer for attachment to the lower drive unit of a boat motor. The stabilizer comprises a first lifting member having a first interior side wall for positioning adjacent to a first side of the drive unit and a first arm portion for extension around the drive unit, and a second lifting member having a second interior side wall for positioning adjacent to a second side of the drive unit and a second arm portion for extension around the drive unit toward the first arm portion. The second interior side wall is spaced from and opposes the first interior side wall forming a slot therebetween for receiving the drive unit. The first and second arm portions are removably attached together and selectively movable toward and away from each other for varying the width of the slot. The ability to vary the width of the slot for receiving the drive unit allows the stabilizer to be adjusted to fit virtually any conventional outboard or inboard/outboard boat motor.

28 Claims, 5 Drawing Sheets

ADJUSTABLE BOAT STABILIZER

This is a continuation of copending application Ser. No. 07/478,589 filed on Sep. 2, 1990. Copending application Ser. No. 07/478,589 filed Feb. 9, 1990 is a continuation-in-part of U.S. Design application Ser. No. 07/210,697, filed Jun. 23, 1988, now U.S. Pat. No. Des. 308,851, issued Jun. 26, 1990.

I. BACKGROUND OF THE INVENTION

1. Field of the Invention

This invention relates in general to boat stabilizers. It particularly relates to boat stabilizers of the type that attach directly to the lower drive unit of a boat motor to provide lift to the stern of the boat.

2. Description of the Prior Art

It is known that the stability, handling characteristics and safety of certain boats (e.g., recreational boats such as ski boats and bass boats) can be greatly improved by the addition of a lifting plate or member to the lower drive unit of the boat. Such plates or members (stabilizers) are typically designed to fit around either the front of the drive unit or the rear of the drive unit and over or adjacent to the anti-cavitation plate thereof. For example, U.S. Pat. Nos. 2,963,000, 3,433,195 and 4,487,152 disclose stabilizers that extend around the front of the drive unit over the anti-cavitation plate thereof. The stabilizers function to lift the stern of the boat up and bring the bow down which causes the boat to plane off more quickly coming out of the "hole" and improves the overall ride and ability to control the boat.

The shape of these types of stabilizers with respect to the drive unit to which they attach is very important. In addition to being held in the proper position with respect to the drive unit, the stabilizer must fit sufficiently tight around the drive unit or it will be difficult to attach and/or lack sufficient strength. Unfortunately, the size and configuration of boat motor drive units and their corresponding anti-cavitation plates vary somewhat from boat to boat. It is impractical to design a separate stabilizer for each type of boat motor that exists.

As a partial solution to the problem, certain two-piece stabilizers are available that consist of one lifting member for attachment on one side of the anti-cavitation plate and a second lifting member for attachment on the opposite side of the anti-cavitation plate. Although these stabilizers can be fit to most drive units irrespective of the size and configuration of the units, they do not have the structural integrity and strength of one-piece stabilizers and, as a result, are more easily damaged during use. For example, two-piece stabilizers may tend to break when they are stepped on by swimmers or skiers attempting to get in the boat.

There is a need for a unitary stabilizer that will properly fit a great variety of drive units irrespective of the size and configuration of the units or their corresponding anti-cavitation plates.

II. SUMMARY OF THE INVENTION

By the present invention, an improved boat stabilizer of the type that attaches directly to the lower drive unit of a boat motor to provide lift to the stern of the boat is provided. Although the inventive stabilizer is effectively a one-piece unit and has the structural integrity and strength thereof, it is adjustable in width to fit the drive unit of virtually any conventional outboard or inboard/outboard boat motor.

The stabilizer comprises a first lifting member having a first interior side wall for positioning adjacent to a first side of the drive unit and a first arm portion for extension around the drive unit, and a second lifting member having a second interior side wall for positioning adjacent to a second side of the drive unit and a second arm portion for extension around the drive unit toward the first arm portion. The second interior side wall is spaced from and opposes the first interior side wall. The first and second arm portions are attached together and selectively movable toward each other for decreasing the distance between the first interior side wall and the second interior side wall.

In one embodiment, the first and second arm portions are selectively slidably positioned one above the other. The first lifting member includes a first shoulder facing the second lifting member, and the second lifting member includes a second shoulder facing the first lifting member. The first arm portion includes an upper surface, a lower surface and a first interior wall, and the second arm portion includes an upper surface, a lower surface and a second interior wall. The first interior wall faces the second shoulder, and the second interior wall faces the first shoulder. When the arm portions are selectively moved toward each other as far as possible, the first interior wall directly abuts the second shoulder, and the second interior wall directly abuts the first shoulder.

It is, therefore, a primary object of the present invention to provide a boat drive unit stabilizer that is effectively a one-piece unit but adjustable in width to fit a large variety of drive units and corresponding anti-cavitation plates irrespective of the size and configuration thereof.

It is an important object of the present invention to provide a boat stabilizer that fits on the lower drive unit of virtually any conventional outboard or inboard/outboard boat motor in a position with respect thereto that greatly improves the stability, control and handling characteristics of the boat.

It is a further object of the present invention to provide an adjustable boat stabilizer that is simple in construction and yet virtually indestructable.

It is a further object of the present invention to provide an adjustable boat stabilizer that is very easy to adjust and install.

Numerous other objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
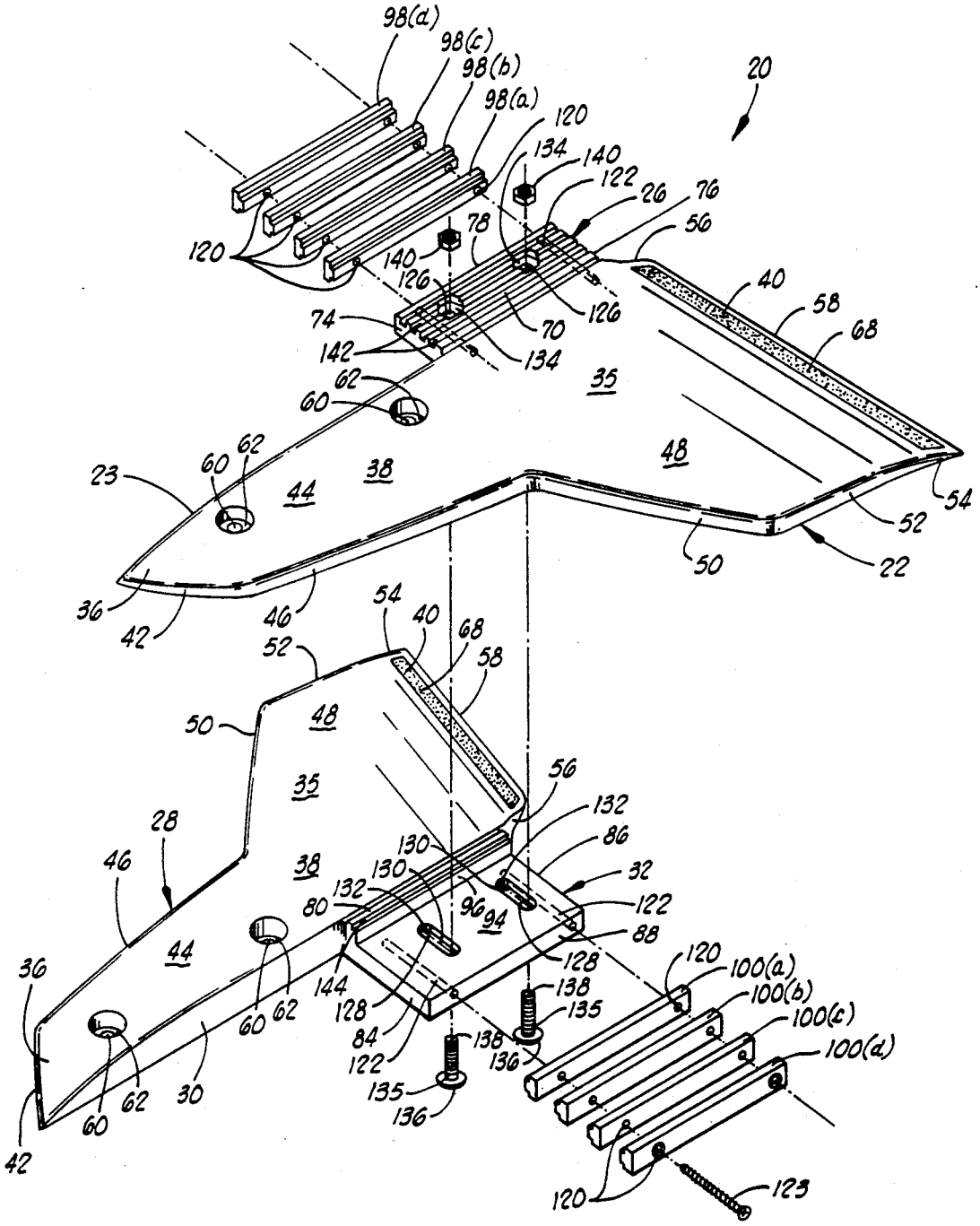
FIG. 1 is an exploded perspective view of a preferred embodiment of the adjustable boat stabilizer of the present invention.
Figure 2:
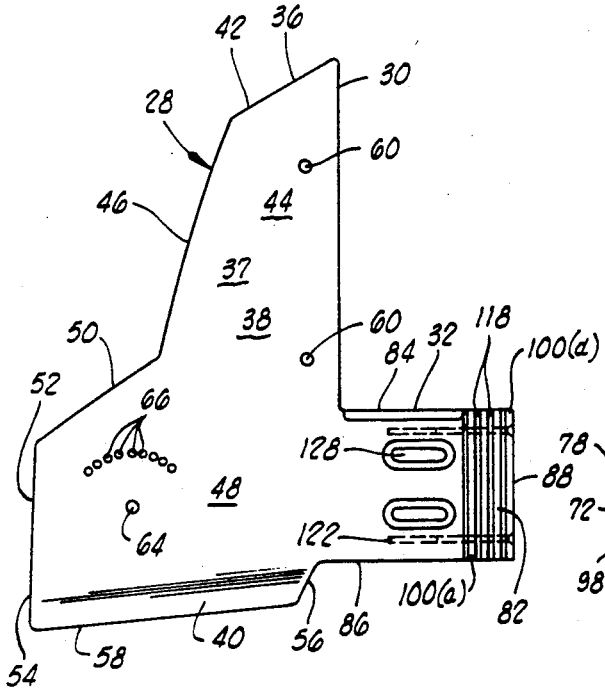
FIG. 2 is a bottom view of the right side lifting member of the stabilizer apparatus shown in FIG. 1.
Figure 3:
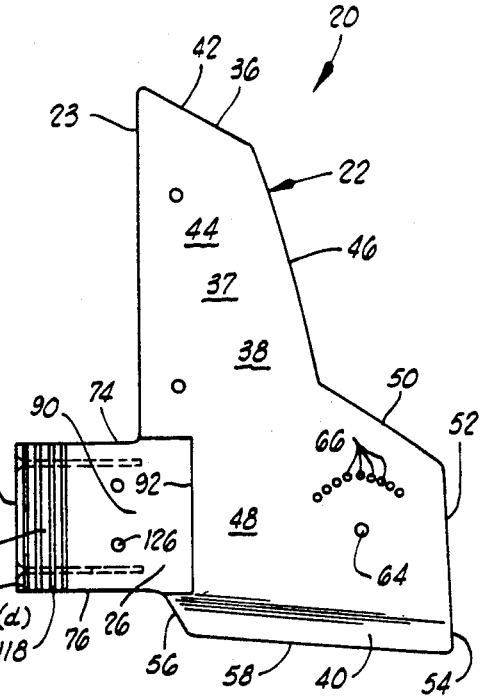
FIG. 3 is a bottom view of the left side lifting member of the stabilizer apparatus shown in FIG. 1.

Referring now to the drawings and particularly to FIGS. 1-8, a preferred embodiment of the boat stabilizer of the present invention is illustrated and generally designated by the numeral 20.

The stabilizer is designed for attachment to the lower drive unit of an outboard or inboard/outboard (stern drive) boat motor. As used herein and in the appended claims, "lower drive unit" (hereinafter "drive unit") means the portion of the boat motor connecting the actual engine to the propeller (sometimes called the motor post or propeller post). In outboard motors, the drive unit extends directly from the engine into the water. In inboard/outboard motors, the drive unit extends from the engine through the stern of the boat and into the water.

Figure 5:
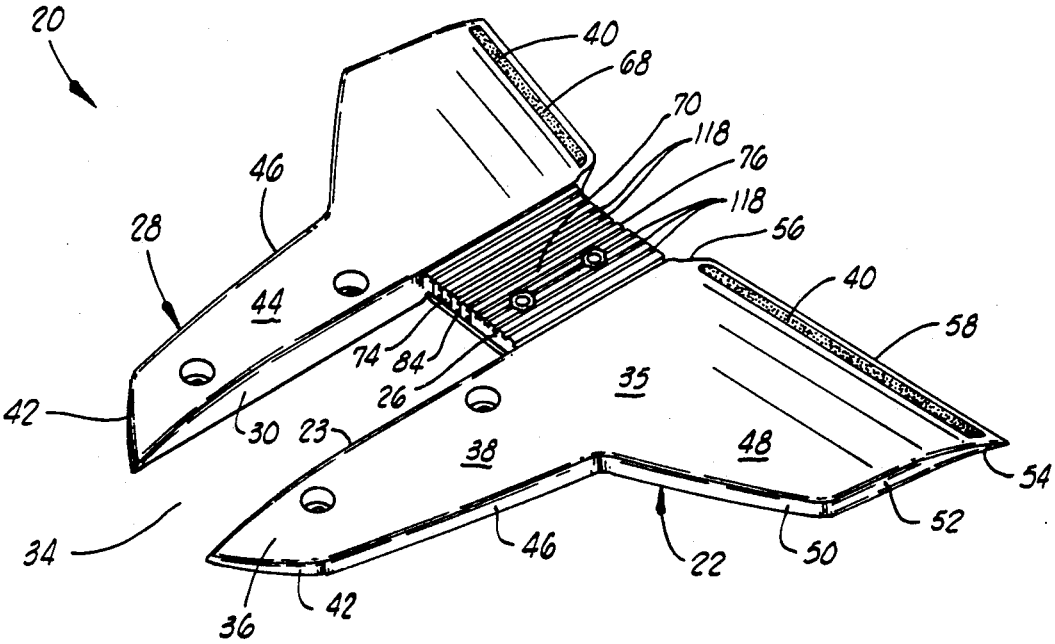
FIG. 5 is a perspective view of the stabilizer apparatus shown in FIG. 1 when the apparatus is assembled.
Figure 6:
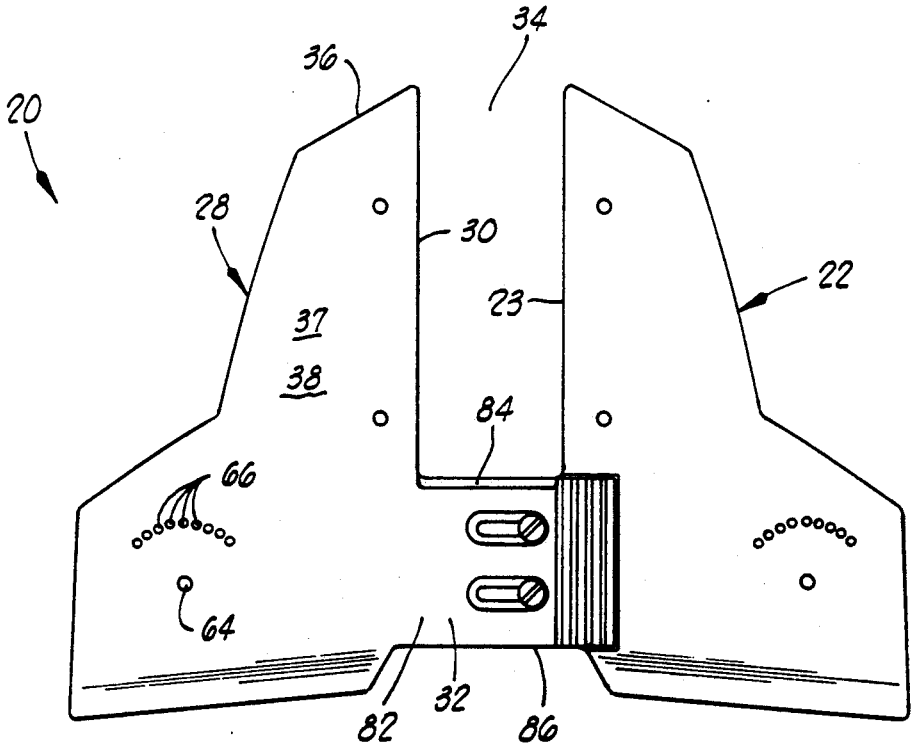
FIG. 6 is a bottom view of the stabilizer apparatus shown in FIG. 1 when the apparatus is assembled.
Figure 8:
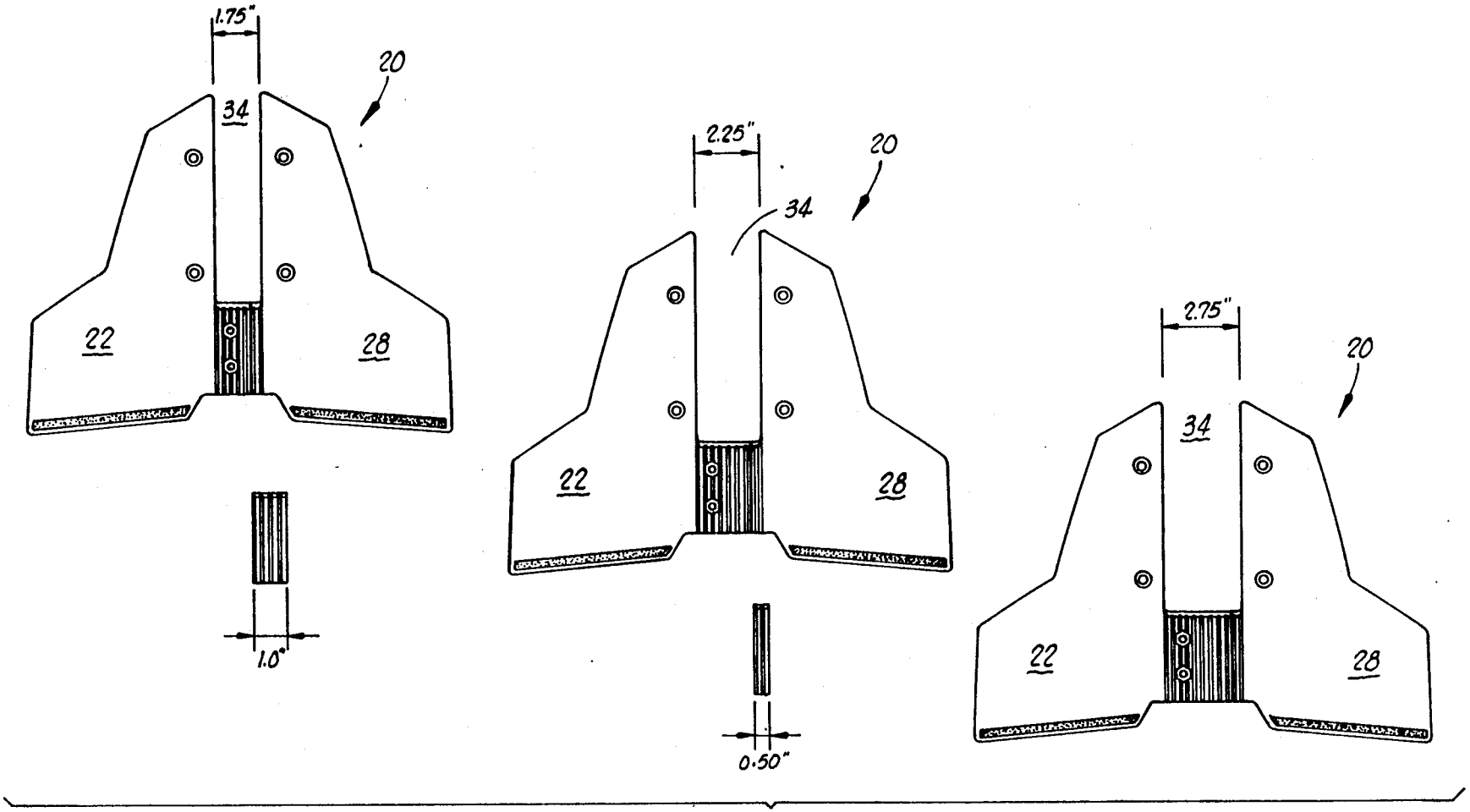
FIG. 8 illustrates how the inventive boat stabilizer is adjustable in width.

. The stabilizer comprises a first lifting member 22 having a first interior side wall 23 for positioning adjacent to a first side of the drive unit and a first arm portion 26 for extension around the drive unit, and a second lifting member 28 having a second interior side wall 30 for positioning adjacent to a second side of the drive unit and a second arm portion 32 for extension around the drive unit toward the first arm portion. The arm portions 26 and 32 are integrally formed with the lifting members 22 and 28, respectively. As best shown in FIGS. 5, 6 and 8, the second interior side wall 30 is spaced from and opposes the first interior side wall 23 forming a slot 34 therebetween for receiving the drive unit. The first interior side wall 23 is a mirror image of the second interior side wall 30. The first lifting member 22 and second lifting member 28 also each include an upper surface 35 and a lower surface 37. The first and second arm portions 26 and 32 are removably attached together and selectively movable toward or away from each other for decreasing or increasing the distance between the first interior side wall 23 and second interior side wall 30. Attachment of the lifting members 22 and 28 together adds a great deal of strength thereto. Attaching the first and second arm portions 26 and 32 together greatly improves the structural integrity and strength of the stabilizer 20 as a whole.

Figure 7:
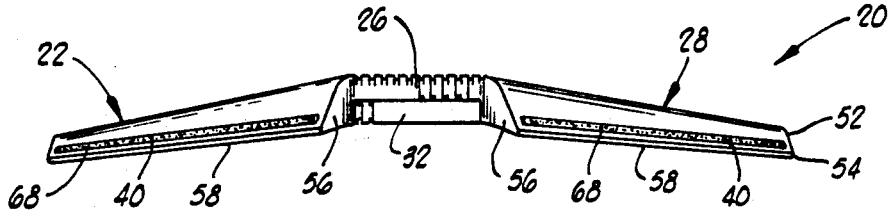
FIG. 7 is a rear end view of the stabilizer apparatus shown in FIG. 1 when the apparatus is assembled.

The lifting members 22 and 28 each include a nose portion 36, a sweeping body portion 38 and a flap portion 40. The nose portions 36 each include a leading edge 42. The sweeping body portions 38 each include a first wing section 44 having a leading edge 46 and a second wing section 48 having a leading edge 50 and side edge 52. The flap portions 40 each have an exterior side edge 54, an interior side edge 56 and a trailing edge 58. As best shown in FIGS. 1, 5 and 7, the first lifting member 22 and second lifting member 28 each have a double negative dihedral wing profile. The members 22 and 28 each taper downwardly (first negative dihedral) and outwardly (second negative dihedral) from their nose portion 36 toward their trailing edge 58 and side edges 52 and 54. The negative dihedral angles are formed with respect to the surface to which the members 22 and 28 are attached.

The lifting members 22 and 28 further each include two openings 60 for allowing them to be bolted to the anti-cavitation plate or other portion of the drive unit. A circular recess 62 for receiving the head of the bolt is disposed on the upper surfaces 35 of the members 22 and 28 directly over each opening 60. This improves the hydrodynamic performance and aesthetic appeal of the stabilizer. The lower surfaces 37 of the lifting members 22 and 28 each include an opening 64 and a plurality of openings 66 for receiving an adjustable torque equalizer (not shown by FIGS. 1-8). The nature and function of such a torque equalizer are discussed in connection with FIG. 11 below.

The upper surfaces 35 of the lifting members 22 and 28 each include a textured surface 68, preferably disposed on the flap portion 40. Due to the excellent structural relationship between the members 22 and 28, the stabilizer 20 can be used as a step by swimmers and skiers to get in and out of the boat. The textured surfaces 68 prevent the bare feet of the swimmers and skiers from slipping off the stabilizer. The textured surfaces 68 also function to reduce the surface tension between the stabilizer and the water allowing the water to flow easier over the surfaces of the stabilizer and improving the hydrodynamic performance thereof. If desired, the textured surfaces 68 can be extended over more of the upper surfaces 35 of the members 22 and 28 and can also be applied to the lower surfaces 37 thereof.

The first arm portion 26 of the first lifting member 22 includes an upper surface 70, a lower surface 72, a front wall 74, a rear wall 76 and an interior wall 78. Similarly, the second arm portion 32 includes an upper surface 80, a lower surface 82, a front wall 84, a rear wall 86 and an interior wall 88. In order to allow for a better fit on some drive units, the front wall 84 of the second arm portion 32 can be tapered downwardly from top to bottom toward the rear wall 86 thereof.

As best shown in FIGS. 5-7, the first and second arm portions 26 and 32 are selectively slidably positioned one above the other to form a tongue and groove-type connection. The lower surface 37 of the first lifting member 22 has a first recess 90 formed therein forming a first shoulder 92 facing the second lifting member 28. The first recess 90 has approximately the same shape and depth as the shape and width of the second arm portion 32. The upper surface 80 of the second arm portion 32 has a second recess 94 formed therein forming a second shoulder 96 facing the first lifting member 22. The second recess 94 has approximately the same shape and depth as the shape and width of the first arm portion 26. The lower surface 72 of the first arm portion 26 is substantially coplanar to the first recess 90. The second interior wall 88 of the second arm portion 32 faces the first shoulder 92 and the first interior wall 78 of the first arm portion 26 faces the second shoulder 96.

A plurality of first spacer bars 98(*a*)-98(*d*) are removably attached to the interior wall 78 of the first arm portion 26 and removably attached together side by side between the first interior wall 78 and the second shoulder 96. Similarly, a plurality of second spacer bars 100(*a*)-100(*d*) are removably attached to the interior wall 88 of the second arm portion 32 and removably attached together side by side between the second interior wall 88 and the first shoulder 92.

Figure 4:
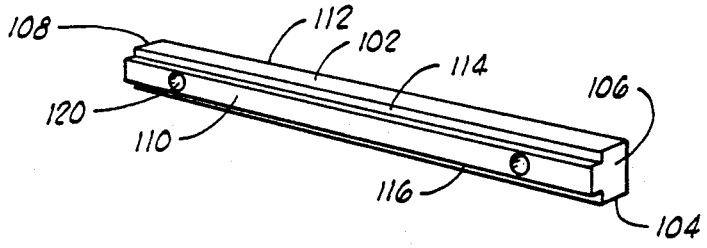
FIG. 4 is a perspective view of a spacer bar of the stabilizer apparatus shown in FIG. 1.

As best shown by FIG. 4, the spacer bars 98 and 100 each include an upper surface 102, a lower surface 104, an end surface 106, an end surface 108, an exterior side surface 110 and an interior side surface 112. The exterior side surfaces 110 of each spacer 98 and 100 have an upper recess 114 and a lower recess 116 which form a plurality of longitudinal grooves 118 when the spacers are attached together. Each spacer bar 98 and 100 is substantially rectangular in shape, has a length and height approximately equal to the length and height of the interior walls 78 and 88 of the arm portions 26 and 32 and is approximately ¼" wide.

The exterior side 110 of the first spacer bar 98(*a*) directly abuts the first interior wall 78 of the first arm portion 26 while the interior side 112 of the first spacer bar 98(*d*) directly abuts the second shoulder 96. Similarly, the exterior side 110 of the second spacer bar 100(*a*) directly abuts the second interior wall 88 of the second arm portion 32 while the interior side 112 of the second spacer bar 100(*d*) abuts the first shoulder 92. The spacer bars 98 and 100 impart a great deal of structural integrity and strength to the stabilizer 20 by structurally reinforcing the tongue in groove-type connection between the first arm portion 26 and second arm portion 32.

The spacer bars 98 and 100 can be removably attached to the first and second arm portions 26 and 32 and together side by side in many ways. For example, as illustrated by FIG. 1, openings 120 can be disposed through each spacer 98 and 100 and openings 122 can be disposed through the first interior wall 78 and second interior wall 88 of the arm portions 26 and 32 and screws such as a screw 123 can be inserted through the openings 120 into the openings 122. This means of attaching the spacer bars 98 and 100 to the interior walls 78 and 88 and to each other allows any number of the spacer bars to be removed and reattached at any time. Alternatively, the spacer bars 98 and 100 can be integrally molded or otherwise formed with the arm portions 26 and 32, respectively. If this means of attachment is employed, the individual spacer bars 98 and 100 are removed by cutting them off with a saw or other tool. The grooves 118 formed by the recesses 114 and 116 in the exterior sides 110 of the spacer bars 98 and 100 facilitate the cutting or removing process by acting as saw guides. The grooves 118 also function to improve the hydrodynamic performance as well as the aesthetic appeal of the stabilizer 20.

Due to the advantage in molding achieved, the spacer bars 98 and 100 are preferably integrally formed with the arm portions 26 and 32 (and hence the lifting members 22 and 28). In addition to the ease in molding it provides, this means of attachment is advantageous because of the increased structural integrity and strength of the connection between the arm portions that unitary construction provides.

As used herein and in the appended claims, the spacer bars 98 and 100 are "removably" attached to the arm portions 26 and 32 and "removably" attached together side by side in the sense that they are attached by means, such as the means described above, that permit them to be easily removed. Although the arrangement shown in the drawings is preferred because of the structural integrity and strength it provides, the positions of the recesses and shoulders of the lifting members and arm portions can be varied if desired. Also, other sizes and numbers of spacers can be employed, if necessary.

A pair of openings 126 are disposed in the first arm portion 26 and a pair of elongated slots 128 are disposed in the second arm portion 132. The longitudinal axes 130 of the slots 128 extend from points 132 adjacent to the second shoulder 94 toward the first lifting member 22. Hexagonal recesses 134 are disposed in the upper surface 70 of the first arm portion 26 over the openings 126 therein. A pair of bolts 135 extend from the lower surface 82 of the second arm portion 32 and through the slots 128 and 126. The head portions 136 of the bolts 135 abut the lower surface 82 of the second arm portion 32, and the threaded end portions 138 of the bolts 135 project into the hexagonal recesses 134. Nuts 140 are threaded onto the threaded end portions 138 to attach the first and second arm portions together and are received by the hexagonal recesses 134. This improves both the hydrodynamic performance and the aesthetic appeal of the stabilizer 20. The longitudinal slots 128 allow the first arm portion 26 to slide toward and away from the second shoulder 96 while the arm portions are attached together so that the distance between the first interior side wall 23 and second interior side wall 30 of lifting members 22 and 28 can be easily adjusted in fitting the stabilizer onto the drive unit.

The upper surface 70 of the first arm portion 26 includes a plurality of grooves 142 for improving the hydrodynamic performance of the stabilizer 20 and matching the grooves 118. Similar grooves 144 are disposed in the upper surface 80 of the second arm portion above the second recess 94. The lifting members 22 and 26, including the arm portions 26 and 32 and the spacer bars 98 and 100, are formed of a material that is stable at both high and low temperature, strong and durable. Preferably, the apparatus are formed of high molecular weight plastics such as polypropylene and rubber copolymers. Such plastics have a very high strength-to-weight ratio.

Referring now particularly to FIGS. 8–11, a method of attaching the stabilizer 20 to the drive unit of a boat motor will be described.

Figure 9:
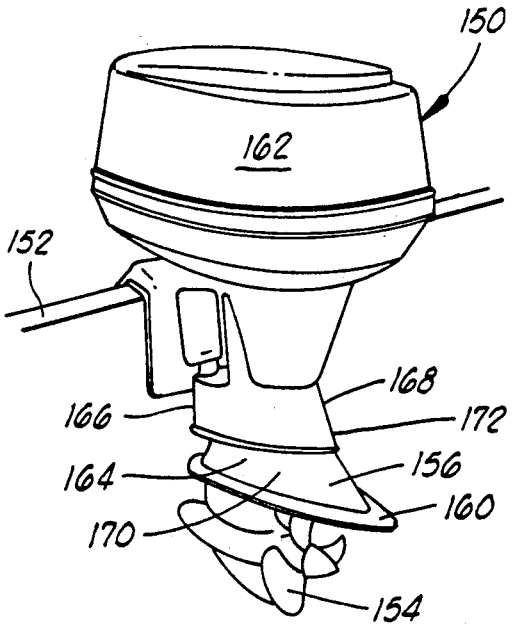
FIG. 9 illustrates a conventional boat motor and corresponding lower drive unit without the inventive stabilizer attached thereto.
Figure 10:
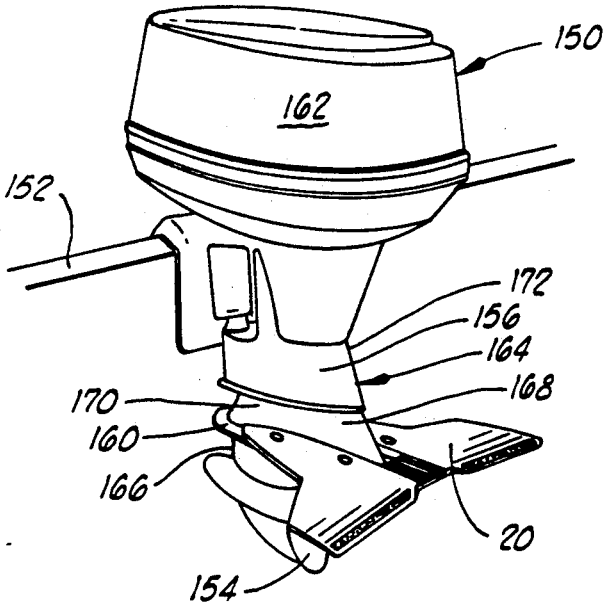
FIG. 10 illustrates a conventional boat motor and corresponding lower drive unit with the inventive stabilizer attached thereto.

A conventional outboard boat motor 150 is illustrated by FIGS. 9 and 10. The motor 150 is connected to a transom portion 152 of the boat hull. The motor 150 includes a propeller 154 which is driven by a propeller shaft (not shown), the shaft being enclosed within a housing 156. The housing 156 carries an anti-cavitation plate 160 which is disposed in a substantially horizontal position in spaced relation from and above the propeller to eliminate and reduce certain cavitation effects that would otherwise be created by rotation of the propeller. Virtually every outboard and inboard/outboard boat motor includes an anti-cavitation plate such as the anti-cavitation plate 160. The boat motor 150 further includes a motor housing 162 and engine (not shown). The propeller 154, shaft, shaft housing 156 and anti-cavitation plate 160 form the lower drive unit (drive unit) 164 of the motor 150. The drive unit 164 has a front end 166, a rear end 168, a first side 170 and a second side 172. The second side 172 of the drive unit 164 is a mirror image of the first side 170 thereof.

The position of the stabilizer 20 with respect to the lower unit 164 is critical. Although the stabilizer can be attached on the lower unit at a variety of points above the propeller 154 in adjacent spaced relation therefrom as long as it is sufficiently submerged beneath the water to provide the desired amount of lift, it is preferably attached directly above, over or directly below the anti-cavitation plate 160. Typically, the anti-cavitation plate 160 will be ½" to 1" below the lowest point on the boat's transom/keel. Preferably, the first lifting member 22 of the stabilizer 20 is bolted to the top of the anti-cavitation plate 160 on the first side 170 of the drive unit 164 and the second lifting member 28 is bolted on top of the anti-cavitation plate on the second side 172 of the drive unit. The stabilizer 20 is most effective when it is in this position.

When properly positioned, the side edges 52 of the second wing sections 48 and the side edges 54 of the flap portions 40 of the lifting members 22 and 28 will submerge in the water during turns made by the boat and as it rocks back and forth at cruising speeds. This causes the stabilizer 20 to act as a keel which prevents the back of the boat from skipping during the turns and reduces or eliminates rocking back and forth due to non-planar surfaces on the boat's hull.

As shown by FIG. 10, the stabilizer 20 is placed around the rear end 168 of the drive unit 164 over the anti-cavitation plate 160 thereof. Although it is not as effective as the preferred embodiment described above, the lifting members can be connected together at the nose portions thereof and the slot for receiving the lower unit can be positioned at the opposite end allowing the stabilizer to slide on to the lower unit from the front side thereof.

The stabilizer 20 can be installed in a very short time. First, the stabilizer 20 is adjusted to the proper width. The first interior side wall 23 and second interior side wall 30 of the members 22 and 28 should fit tightly against the first side 170 and second side 172, respectively, of the drive unit 164 with the trailing edges 58 of the lifting members perpendicular to the drive unit. Although it is effective in all positions, the stabilizer is most effective (e.g., provides more lift) when it is positioned as far to the rear end 168 of the lower unit 164 as possible. The stabilizer was designed such that most drive unit housings will not entirely fill the center slot 34. This allows for adequate water flow into the cooling intakes.

If the stabilizer 20 does not properly fit, it can be adjusted accordingly. As illustrated by FIG. 8, the width of the slot 34 can be decreased from approximately 2.75 inches to 1.75 inches. This decreases the wingspan of the stabilizer from 14 inches to 13 inches. This width range allows the stabilizer to properly fit virtually any conventional lower unit. To decrease the width of the slot 34, the first lifting member 22 is first removed from the second lifting member 28 by removing the bolts 35 from the openings 126 and slots 128 and separating the members. The appropriate number of spacer bars are then removed from each arm portion. For example, if the slot 34 is one half of an inch too wide, two spacer bars are removed from each arm portion. If the spacer bars are fastened to the interior walls of the arm portion and to each other by screws, the screws are backed out and the spacer bars are removed starting with the spacer bars closest to the interior walls 78 and 88 of the arm portions. In order to decrease the width of the slot by one half of an inch, the spacer bars 98(*a*), 98(*b*), 100(*a*) and 100(*b*) are removed. In order for the arms to properly fit back together, an equal number of spacer bars must always be removed from each arm portion.

If the spacer bars are integrally formed with the arm portions and together, the spacer bars are removed starting with the spacer bars furthest away from the interior walls 78 and 88 of the arm portions. In order to decrease the width of the slot by one half of an inch, the spacer bars 98(*c*), 98(*d*), 100(*c*) and 100(*d*) are removed. Using the groove 118 between the spacer bars 98(*c*) and 98(*b*) on the arm portion 26, and the groove 118 between the spacer bars 100(*c*) and 100(*b*) on the arm portion 32, as guides, the spacer bars are removed. Once the proper width of the slot 34 is achieved, the members 22 and 28 are fastened back together and the stabilizer 20 is mounted to the anti-cavitation plate. Four holes are drilled through the cavitation plate using the openings 66 as guides and the stabilizer is bolted thereto.

The stabilizer 20 forces the stern of the boat up and keeps the bow down. It gets the boat up on plane in less than half the normal time and eliminates the dangerous and burdensome cavitation and porpoising associated with many boats. Boats with the inventive stabilizer can pull skiers up faster with less power and are more stable with improved control and ride. The stabilizer can result in a savings in fuel and an increase in top end speed.

The stabilizer 20 functions by creating a higher water pressure on the lower surfaces of the lifting members which results in lift and forces the stern of the boat up. The rear upward force, even at low speeds, keeps the bow down and brings the boat out of the "hole" in less time with less power. Unlike trim tabs, the inventive stabilizer has a very low drag coefficient which brings out the hidden peak performance of every boat. Boats having the stabilizer 20 attached thereto handle, ride and track (even in turns) better.

The inventive stabilizer is easy to install, virtually indestructible and does not require any maintenance. The fact that it is adjustable in width allows it to be used in connection with boat motors having anywhere from one or two horsepower to three hundred horsepower and up. It can be used in connection with big or small runabouts, ski boats, bass boats, pontoon boats, inflatable boats and cruisers. The stabilizer allows boats to turn without losing propeller bite (i.e., without cavitating). It allows for better stability and maneuverability at high speeds and reduces the annoying back-and-forth wander at low speeds.

Figure 11:
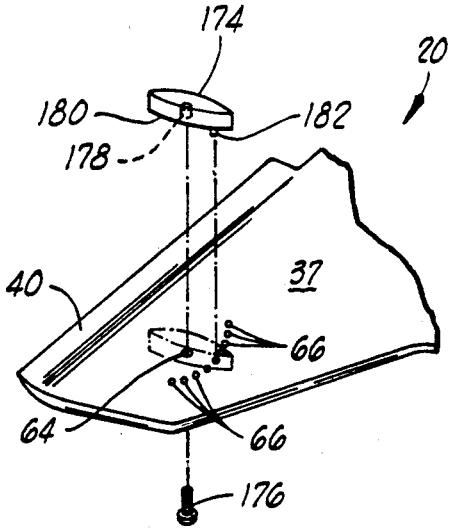
FIG. 11 illustrates use of a torque equalizer in connection with the stabilizer apparatus shown in FIG. 1.

Referring now to FIG. 11, the use of torque equalizers in connection with the stabilizer 20 is described. As shown, a torque equalizer 174 can be attached to the lower surfaces 37 of both lifting members 22 and 28. Using the openings 64 as guides, holes are drilled through the lifting members and bolts are inserted from the upper surfaces 35 of the lifting members through the openings 64 into corresponding openings 178 in the upper surfaces 180 of the torque equalizers. The torque equalizers can be positioned at various 10° angle increments (up to 40° right or left) to provide for maximum latitude and adjustment. Pegs 182 on the upper surfaces 180 of the equalizers are positioned in the appropriate openings 66 in the lower surfaces 37 of the lifting members.

The torque equalizers function to neutralize tiresome and dangerous steering/propeller torque experienced by all boats. Boats having the stabilizer 20 and corresponding torque equalizers 174 attached thereto track straighter and are easier to control. It is the positioning and shape of the stabilizer 20 that allows the torque equalizers 176 to function so well. The torque equalizers 174 can be made of the same material that forms the stabilizer 20.

Thus, the stabilizer of the present invention is well adapted to carry out the objects and attain the ends and advantages mentioned as well as those inherent therein. Although numerous changes in the construction and arrangement of parts will suggest themselves to those skilled in the art, such changes are encompassed within the spirit of this invention as defined in the appended claims.

What is claimed is:

1. A boat stabilizer for attachment to the lower drive unit of a boat motor of a boat to provide lift to the stern of the boat comprising:

a first lifting member for providing lift to the stern of the boat having a first interior side wall for positioning adjacent to a first side of said drive unit and a first arm portion for extension around said drive unit; and a second lifting member for providing lift to the stern of the boat having a second interior side wall for positioning adjacent to a second side of said drive unit and a second arm portion for extension around said drive unit toward said first arm portion, said second interior side wall being spaced from and opposing said first interior side wall and said first and second arm portions being in direct contact with and directly attached to each other and selectively movable toward each other for decreasing the distance between said first interior side wall and said second interior side wall.

2. The boat stabilizer of claim 1 wherein said first and second arm portions are selectively slidably positioned one above the other.

3. The boat stabilizer of claim 2 wherein:

said first lifting member includes a first shoulder facing said second lifting member;

said second lifting member includes a second shoulder facing said first lifting member;

said first arm portion includes an upper surface, a lower surface and a first interior wall, said first interior wall facing said second shoulder; and said second arm portion includes an upper surface, a lower surface and a second interior wall, said second interior wall facing said first shoulder.

4. The boat stabilizer of claim 3 further comprising:

a first spacer bar removably attached to said first arm portion and positioned between said first interior wall of said second shoulder, said first spacer bar having an exterior side abutting said first interior wall and an interior side abutting said second shoulder; and a second spacer bar removably attached to said second arm portion and positioned between said second interior wall and said first shoulder, said second spacer bar having an exterior side abutting said second interior wall and an interior side abutting said first shoulder.

5. The boat shoulder of claim 3 further comprising:

a plurality of first spacer bars removably attached to said first arm portion and removably attached together side by side between said first interior wall and said second shoulder, the fist spacer bar closest to said first interior wall having an exterior side abutting said first interior wall and the first spacer bar closest to said second shoulder having an interior side abutting said second shoulder; and a plurality of second spacer bars removably attached to said second arm portion and removably attached together side by side between said second interior wall and said first shoulder, the second spacer bar closest to said second interior wall having an exterior side abutting said second interior wall and the second spacer bar closest to said first shoulder having an interior side abutting said first shoulder.

6. The boat stabilizer of claim 2 wherein:

said first and second lifting members each include an upper surface and a lower surface, said lower surface of said first lifting member having a first recess formed therein forming a first shoulder facing said second lifting member;

said second arm portion includes an upper surface, a lower surface and a second interior wall, said upper surface having a second recess formed therein forming a second shoulder facing said first lifting member;

said first arm portion includes an upper surface, a lower surface and a first interior wall, said lower surface being substantially coplanar to said first recess; and wherein said second interior wall faces said first shoulder and said first interior wall faces said second shoulder.

7. The boat stabilizer of claim 6 further comprising:

a first spacer bar removably attached to said first arm portion and positioned between said first interior wall and said second shoulder, said first spacer bar having an exterior side abutting said first interior wall and an interior side abutting said second shoulder; and a second spacer bar removably attached to said second arm portion and positioned between said second interior wall and said first shoulder, said second spacer bar having an exterior side wall abutting said second interior wall and an interior side abutting said first shoulder.

8. The boat stabilizer of claim 6 further comprising:

a plurality of first spacer bars removably attached to said first arm portion and removably attached together side by side between said first interior wall and said second shoulder, the fist spacer bar closest to said first interior wall having an exterior side abutting said first interior wall and the first spacer bar closest to said second shoulder having an interior side abutting said second shoulder; and a plurality of second spacer bars removably attached to said second arm portion and removably attached together side by side between said second interior wall and said first shoulder, the second spacer bar closest to said second interior wall having an exterior side abutting said second interior wall and the second spacer bar closest to said first shoulder having an interior side abutting said first shoulder.

9. The boat stabilizer of claim 8 wherein said first spacer bars are integrally formed with said first arm portion and said second spacer bars are integrally formed with said second arm portion.

10. The boat stabilizer of claim 7 wherein said first spacer bar is integrally formed with said first arm portion and said second spacer bar is integrally formed with said second arm portion.

11. The boat stabilizer of claim 6 wherein:

said first arm portion includes at least one opening extending through both the upper and lower surfaces thereof;

said second arm portion includes at least one longitudinal slot extending through both the upper and lower surfaces thereof, the longitudinal axis of said slot extending from a point adjacent to said second shoulder toward said first lifting member; and said boat stabilizer further comprises: a bolt extending through said opening and said longitudinal slot, said bolt having a head portion abutting said upper surfaces of said first arm portion and a threaded end portion projecting below said lower surface of said second arm portion; and a nut threaded onto said threaded end portion of said bolt to attach said first and second arm portions together.

12. The boat stabilizer of claim 1 wherein said boat motor includes an anti-cavitation plate and said first and second lifting members each further have means for allowing the lifting member to be fastened directly to said anti-cavitation plate.

13. The boat stabilizer of claim 12 wherein said first and second lifting members each further have means for allowing the lifting member to be fastened directly to the top of said anti-cavitation plate.

14. A boat stabilizer for attachment to the lower drive unit of a boat motor of a boat above the propeller and adjacent to the anti-cavitation plate of the motor to provide lift to the stern of the boat comprising:

a first lifting member for providing lift to the stern of the boat having a first interior side wall for positioning adjacent to a first side of said drive unit, a first arm portion for extension around said drive unit and a wing section of a size sufficient for extension outwardly in a perpendicular direction from said first side of said drive unit at least twice as far as said anti-cavitation plate extends outwardly in a perpendicular direction from said first side of said drive unit; and a second lifting member for providing lift to the stern of the boat having a second interior side wall for positioning adjacent to a second side of said drive unit, a second arm portion for extension around said drive unit toward said first arm portion and a wing section of a size sufficient for extension outwardly in a perpendicular direction from said second side of said drive unit at least twice as far as said anti-cavitation plate extends outwardly in a perpendicular direction from said second side of said drive unit, said second interior side wall being spaced from and opposing said first interior side wall and said first and second arm portions being attached together and selectively movable toward each other for decreasing the distance between said first interior side wall and said second interior side wall.

15. The boat stabilizer of claim 14 wherein said first and second arm portions are selectively slidably positioned one above the other.

16. The boat stabilizer of claim 15 wherein:

said first lifting member includes a first shoulder facing said second lifting member;

said second lifting member includes a second shoulder facing said first lifting member;

said first arm portion includes an upper surface, a lower surface and a first interior wall, said first interior wall facing said second shoulder; and said second arm portion includes an upper surface, a lower surface and a second interior wall, said second interior wall facing said first shoulder.

17. The boat stabilizer of claim 16 further comprising;

a first spacer bar removably attached to said first arm portion and positioned between said first interior wall and said second shoulder, said first spacer bar having an exterior side abutting said first interior wall and an interior side abutting said second shoulder; and a second spacer bar removably attached to said second arm portion and positioned between said second interior wall and said first shoulder, said second spacer bar having an exterior side abutting said second interior wall and an interior side abutting said first shoulder.

18. The boat stabilizer of claim 16 further comprising:

a plurality of first spacer bars removably attached to said first arm portion and removably attached together side by side between said first interior wall and said second shoulder, the fist spacer bar closest to said first interior wall having an exterior side abutting said first interior wall and the first spacer bar closest to said second shoulder having an interior side abutting said second shoulder; and a plurality of second spacer bars removably attached to said second arm portion and removably attached together side by side between said second interior wall and said first shoulder, the second spacer bar closest to said second interior wall having an exterior side abutting said second interior wall and the second spacer bar closest to said first shoulder having an interior side abutting said first shoulder.

19. The boat stabilizer of claim 15 wherein:

said first and second lifting members each include an upper surface and a lower surface, said lower surface of said first lifting member having a first recess formed therein forming a first shoulder facing said second lifting member;

said second arm portion includes an upper surface, a lower surface and a second interior wall, said upper surface having a second recess formed therein forming a second shoulder facing said first lifting member;

said first arm portion includes an upper surface, a lower surface and a first interior wall, said lower surface being substantially coplanar to said first recess; and wherein said second interior wall faces said first shoulder and said first interior wall faces said second shoulder.

20. The boat stabilizer of claim 19 further comprising:

a first spacer bar removably attached to said first arm portion and positioned between said first interior wall and said second shoulder, said first spacer bar having an exterior side abutting said first interior wall and an interior side abutting said second shoulder; and a second spacer bar removably attached to said second arm portion and positioned between said second interior wall and said first shoulder, said second spacer bar having an exterior side wall abutting said second interior wall and an interior side abutting said first shoulder.

21. The boat stabilizer of claim 19 further comprising:

a plurality of first spacer bars removably attached to said first arm portion and removably attached together side by side between said first interior wall and said second shoulder, the fist spacer bar closest to said first interior wall having an exterior side abutting said first interior wall and the first spacer bar closest to said second shoulder having an interior side abutting said second shoulder; and a plurality of second spacer bars removably attached to said second arm portion and removably attached together side by side between said second interior wall and said first shoulder, the second spacer bar closest to said second interior wall having an exterior side abutting said second interior wall and the second spacer bar closest to said first shoulder having an interior side abutting said first shoulder.

22. The boat stabilizer of claim 21 wherein said first spacer bars are integrally formed with said first arm portion and said second spacer bars are integrally formed with said second arm portion.

23. The boat stabilizer of claim 20 wherein said first spacer bar is integrally formed with said first arm portion and said second spacer bar is integrally formed with said second arm portion.

24. The boat stabilizer of claim 19 wherein:

said first arm portion includes at least one opening extending through both the upper and lower surfaces thereof;

said second arm portion includes at least one longitudinal slot extending through both the upper and lower surfaces thereof, the longitudinal axis of said slot extending from a point adjacent to said second shoulder toward said first lifting member; and said boat stabilizer further comprises: a bolt extending through said opening and said longitudinal slot, said bolt having a head portion abutting said upper surfaces of said first arm portion and a threaded end portion projecting below said lower surface of said second arm portion; and a nut threaded onto said threaded end portion of said bolt to attach said first and second arm portions together.

25. The boat stabilizer of claim 14 wherein:

said lower drive unit is positioned adjacent to the rear end of said boat and has a front end facing said boat and a rear end opposing said front end and connected to said front end by said first and second sides of said drive unit;

said first arm portion is for extension around said rear end of said drive unit, said second arm portion is for extension around said rear end of said drive unit toward said first arm portion and said second interior side wall is spaced from and opposes said first interior side wall forming a slot between said first and second side walls for receiving said rear end of said drive unit; and said first and second lifting members and said first and second arm portions are of a size sufficient for extension outwardly from said rear end of said boat in a parallel direction from said first and second sides of said drive unit further than said propeller extends outwardly from said rear end of said boat in a parallel direction from said first and second sides of said drive unit.

26. The boat stabilizer of claim 14 wherein said first and second lifting members each further have means for allowing the lifting member to be fastened directly to said anti-cavitation plate.

27. The boat stabilizer of claim 14 wherein said first and second lifting members each further have means for allowing the lifting member to be fastened directly to the top of said anti-cavitation plate.

28. The boat stabilizer of claim 14 wherein said first and second arm portions are in direct contact with and directly attached to each other.

* * * * *

UNITED STATES PATENT AND TRADEMARK OFFICE

CERTIFICATE OF CORRECTION

PATENT NO. : 5,107,786

DATED : April 28, 1992

INVENTOR(S) : Arthur R. Templeman

It is certified that error appears in the above-identified patent and that said Letters Patent is hereby corrected as shown below:

Column 9, line 61, delete "fist" and substitute --first-- therefor;

Column 10, line 41, delete "fist" and substitute --first-- therefor;

Column 11, line 6, delete "surfaces" and substitute --surface-- therefor;

Column 12, line 15, delete "fist" and substitute --first-- therefor;

Column 12, line 62, delete "fist" and substitute --first-- therefor; and

Column 13, line 27, delete "surfaces" and substitute --surface-- therefor.

Signed and Sealed this

Tenth Day of August, 1993

*Attest:*

Michael K. Kirk

MICHAEL K. KIRK

*Attesting Officer*

*Acting Commissioner of Patents and Trademarks*